US010257605B2

(12) United States Patent
Lee

(10) Patent No.: US 10,257,605 B2
(45) Date of Patent: Apr. 9, 2019

(54) EARPHONE PROTECTION DEVICE

(71) Applicant: Jong Gi Lee, Gwangju (KR)

(72) Inventor: Jong Gi Lee, Gwangju (KR)

( * ) Notice: Subject to any disclaimer, the term of this patent is extended or adjusted under 35 U.S.C. 154(b) by 4 days.

(21) Appl. No.: 15/682,119

(22) Filed: Aug. 21, 2017

(65) Prior Publication Data

US 2019/0028798 A1 Jan. 24, 2019

(30) Foreign Application Priority Data

Jul. 20, 2017 (KR) ..... 10-2017-0091790

(51) Int. Cl.
*H04R 1/10* (2006.01)
*H04R 1/12* (2006.01)

(52) U.S. Cl.
CPC ..... *H04R 1/12* (2013.01); *H04R 1/1016* (2013.01); *H04R 1/1033* (2013.01); *H04R 1/1091* (2013.01)

(58) Field of Classification Search
CPC ..... H04R 1/12; H04R 1/1016; H04R 1/1091; H04R 1/1033
See application file for complete search history.

(56) References Cited

U.S. PATENT DOCUMENTS 9,408,021 B2 * 8/2016 Park ..... H04M 1/05

FOREIGN PATENT DOCUMENTS

CN 106470367 A 3/2017

* cited by examiner

*Primary Examiner* — Brian Ensey
(74) *Attorney, Agent, or Firm* — KORUS Patent, LLC; Seong Il Jeong

(57) ABSTRACT

Disclosed herein is an earphone protection device. The earphone protection device includes a pair of earphone covers and a pair of adjustment cables. An outer first space and an inner second space are formed inside each of the earphone covers. The first space provides a path adapted to guide earphones through accommodation, and also provides a coupling structure so that the earphone covers are assembled together and closed after the earphones have been accommodated inside the earphone covers.

5 Claims, 5 Drawing Sheets

EARPHONE PROTECTION DEVICE

BACKGROUND

1. Technical Field

The present invention relates generally to an earphone protection device. More specifically, the present invention relates to a portable earphone protection device which can accommodate and protect earphones.

2. Description of the Related Art

Persons who move by walking or by a means of public transportation, such as the subway or a bus, and enjoy sports chiefly use earphones, which are small in volume and have desirable portability, when using portable audio devices, such as mobile phones, MP3 players, etc.

Such earphones are chiefly stored in a pocket or bag after use, and thus there are cases where impurities are infiltrated into the earphones. When such a phenomenon is repeated, a problem may occur in that sound quality is degraded by the impurities or the auditory canal is exposed to bacteria due to the impurities.

In order to overcome the above problem, the inventor proposed, in Korean Patent No. 1607199, a pair of earphone covers in one side of which an open inner space was formed to receive the speakers of earphones.

In spite of the creativity and usability of the earphone covers disclosed in the above patent, when earphones are accommodated in the earphone covers and not used, the earphone covers continuously accommodate the earphones in an open state. Accordingly, disadvantages arise in that it is inconvenient to store earphones, it is inconvenient for a user to perform actions because earphones branch into two lines and thus the earphone covers occupy a large space, and earphones are easily separated from the earphone covers by small external force.

The present invention has been conceived to eliminate the above disadvantages and to provide an earphone protection device which is compact, robust, and sanitary.

SUMMARY

The present invention has been conceived to overcome the above-described problems, and an object of the present invention is to provide an earphone protection device capable of protecting earphones even after the earphones have been accommodated, which is safe, compact, and sanitary.

In order to accomplish the above object, the present invention provides an earphone protection device, including: a pair of earphone covers and a pair of adjustment cables; wherein an outer first space and an inner second space are formed inside each of the earphone covers, and the first space provides a path adapted to guide earphones through accommodation and also provides a coupling structure so that the earphone covers are assembled together and closed after the earphones have been accommodated inside the earphone covers.

Stepped portions configured to come into contact with surfaces of the earphones may be formed on respective inner circumferential surfaces of the earphone covers, and the outer first space and the inner second space may be defined based on each of the stepped portions.

An open first side surface may be formed at the entrance of each of the earphone covers, and a curved closed second side surface is formed opposite the first side surface; and one stop protrusion and one accommodation depression may be formed on the inside of the front end of the first side surface of one of the pair of earphone covers, and another accommodation depression and another stop protrusion configured to be engaged with the one stop protrusion and the one accommodation depression may be formed on the inside of the front end of the first side surface of the other one of the pair of earphone covers.

An open first side surface may be formed at the entrance of each of the earphone covers, and a curved closed second side surface may be formed opposite the first side surface; and first screw threads may be formed on the inside of the front end of the first side surface of one of the pair of earphone covers, and second screw threads configured to be engaged with the first screw threads may be formed on the inside of the front end of the first side surface of the other one of the pair of earphone covers.

An open slot configured to receive and accommodate the earphones may be formed through the bottom surfaces of the earphone covers.

Each of the adjustment cables may include a loop connected to each of cables of the earphones and a long connection line configured to extend from the loop, a length adjustment member may be located between the loop and the connection line, and an enlarged portion may be formed at the front end of the connection line.

The earphone covers may be made of elastic soft or hard plastic or rubber, and may include frames composed of housings having a sideways "U"-shaped section.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION

Figure 1:
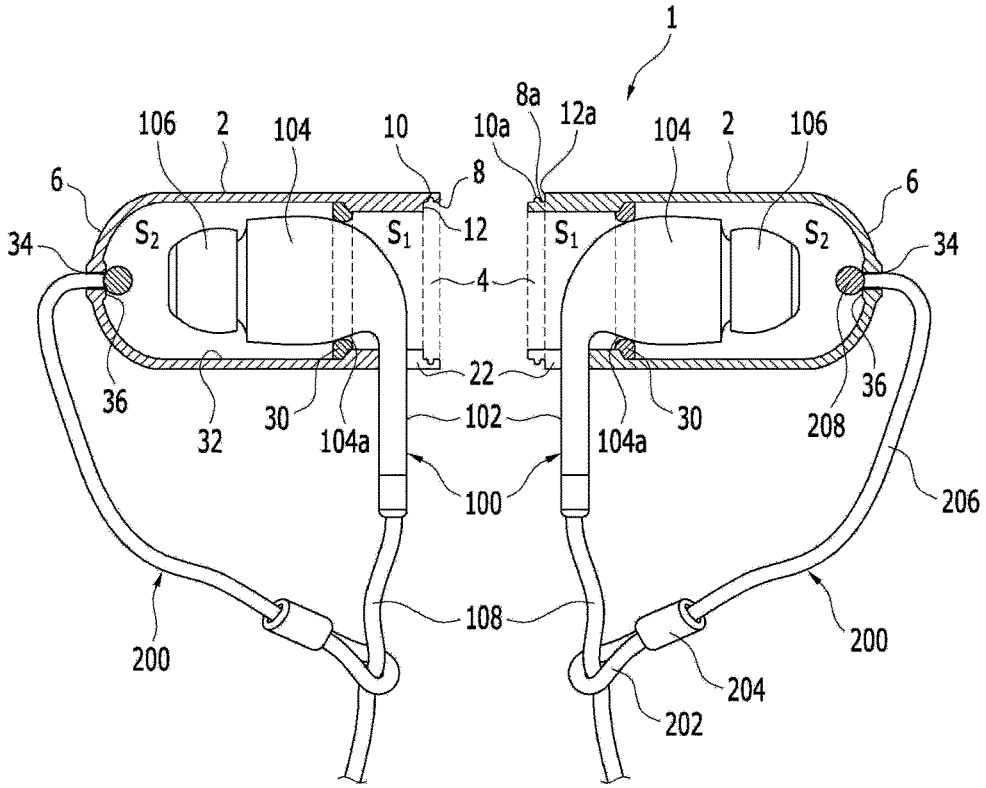
FIG. 1 is a sectional view showing a state in which earphones are accommodated in an earphone protection device according to the present invention.

Some embodiments of the present invention will be described in detail below with reference to illustrative drawings. It should be noted that the same elements in the drawings are designated by the same reference symbols as far as possible even when they are shown in different drawings. Furthermore, in the following description of the present invention, when it is determined that a detailed description of a related well-known configuration or function may make the gist of the present invention obscure, the detailed description will be omitted.

In the following description of the components of the present invention, symbols, such as first, second, i), ii), (a), (b), etc., may be used. These are used merely to distinguish one component from another, and are not intended to limit the essentials, order or sequence of the components. Furthermore, throughout the specification and the claims, when any portion is described as "including" or "comprising" any component, this does not mean that the portion excludes another component, but means that the portion may include another component, unless otherwise clearly specified.

FIG. 1 is a sectional view showing a state in which earphones 100 are accommodated in an earphone protection device 1 according to the present invention.

The earphone protection device 1 includes a pair of earphone covers 2 and a pair of adjustment cables 200.

The pair of earphone covers 2 have a sideways "U"-shaped section, and are symmetrical except for the mutual engagement structures of open entrances.

The earphone covers 2 are made of elastic soft or hard plastic or rubber, and have frames composed of housings having a sideways "U"-shaped section. In each of the earphone covers 2, an outer first space S1 and an inner second space S2 are defined based on a stepped portion 30 formed on the inner circumferential surface of the earphone cover 2.

The first space S1 provides a path adapted to guide the earphone 100 through accommodation, and also provides a coupling structure adapted to close the earphone covers 2 after the earphone 100 has been accommodated in the earphone covers 2.

An open first side surface 4 is formed at the entrance of the housing, and a curved closed second side surface 6 is formed opposite the first side surface 4.

A stop protrusion 8 and an accommodation depression 10 are sequentially formed on the inner side of the front end of the first side surface of one of the pair of earphone covers 2, i.e., the left earphone cover 2 in the shown example, and a stop protrusion 10*a* and an accommodation depression 8*a* are sequentially formed on the inner side of the front end of the first side surface of the other of the pair of earphone covers 2, i.e., the right earphone cover 2 in the shown example. Reference symbols 12 and 12*a* designate support surfaces configured to come into contact with the front end surfaces of the entrances of the corresponding counterpart earphone covers 2. When the earphone covers 2 are coupled to each other by pushing them from both sides, the stop protrusions 8 are engaged with the corresponding accommodation depressions 8*a*, and the accommodation depressions 10 accommodate the corresponding stop protrusions 10*a*, thereby enabling the two earphone covers 2 to be firmly assembled together.

Figure 6:
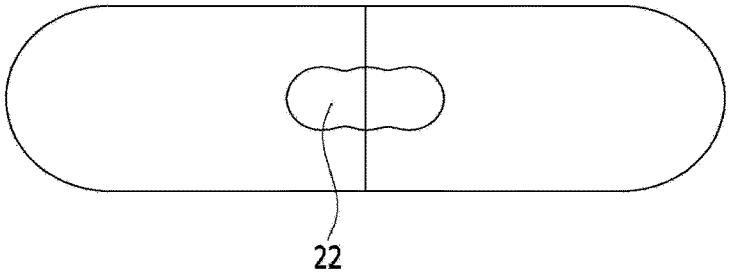
FIG. 6 is a perspective view showing an open slot formed through the bottom surfaces of earphone covers.

As clearly shown in FIG. 6, an open slot 22 is formed in the bottom surfaces 32 of the earphone covers 2. The neck portions 102 of the earphones 100 are inserted through the open slot 22. The open slot 22 functions as a path adapted to guide the earphones 100 through accommodation.

An open hole 34 configured to receive the adjustment cable 200 is formed in a part of the second side surface 6 of each of the earphone covers 2, and a reinforced portion 36 configured to be thicker than the other portion is formed around the open hole 34.

Meanwhile, each of the earphones 100 includes a body 104, an ear cap 106 disposed in front of the body 104, and a neck portion 102 in back of the body 104, but is not particularly limited thereto. A cable 108 configured to be connected to an electronic device, such as a smartphone, is connected to the neck portion 102. An inclined portion 104*a* is formed between the body 104 and the neck portion 102. When the earphones 100 are inserted into the earphone covers 2, the inclined portions 104*a* come into contact with the stepped portions 30 and provide a stable accommodation structure. In the case of the earphones 100 without inclined portions 104*a*, the disposition of the stepped portions 30 is not essential.

The adjustment cables 200 are connected between the earphone covers 2 and the cables 108, and function to enable the earphone covers 2 to always accompany the earphones 100 without separation or loss.

Each of the adjustment cables 200 includes a loop 202 connected to the cable 108 and a long connection line 206 configured to extend from the loop 202. A length adjustment member 204 is located between the loop 202 and the connection line 206, and an enlarged portion 208 is formed at the front end of the connection line 206. Since the enlarged portion 208 of the adjustment cable 200 is formed to be larger than the open hole 34 of the second side surface 6 of the earphone cover 2, the enlarged portion 208 is not moved out of the open hole 34 to the outside.

When the earphones 100 are inserted into the earphone protection device 1 according to the present invention, the earphones 100 are seated by inserting the neck portions 102 to the locations where the inclined portions 104*a* are moved over and caught on the stepped portions 30 via the open slot 22 of the bottom surfaces 32 of the earphone covers 2 by using the elasticity of the stepped portions 30. In contrast, when the earphones 100 are taken out of the earphone protection device 1, the inclined portions 104*a* are separated from the stepped portions 30 in the state of holding the neck portions 102, and the earphones 100 are moved back via the open slot 22.

Figure 2:
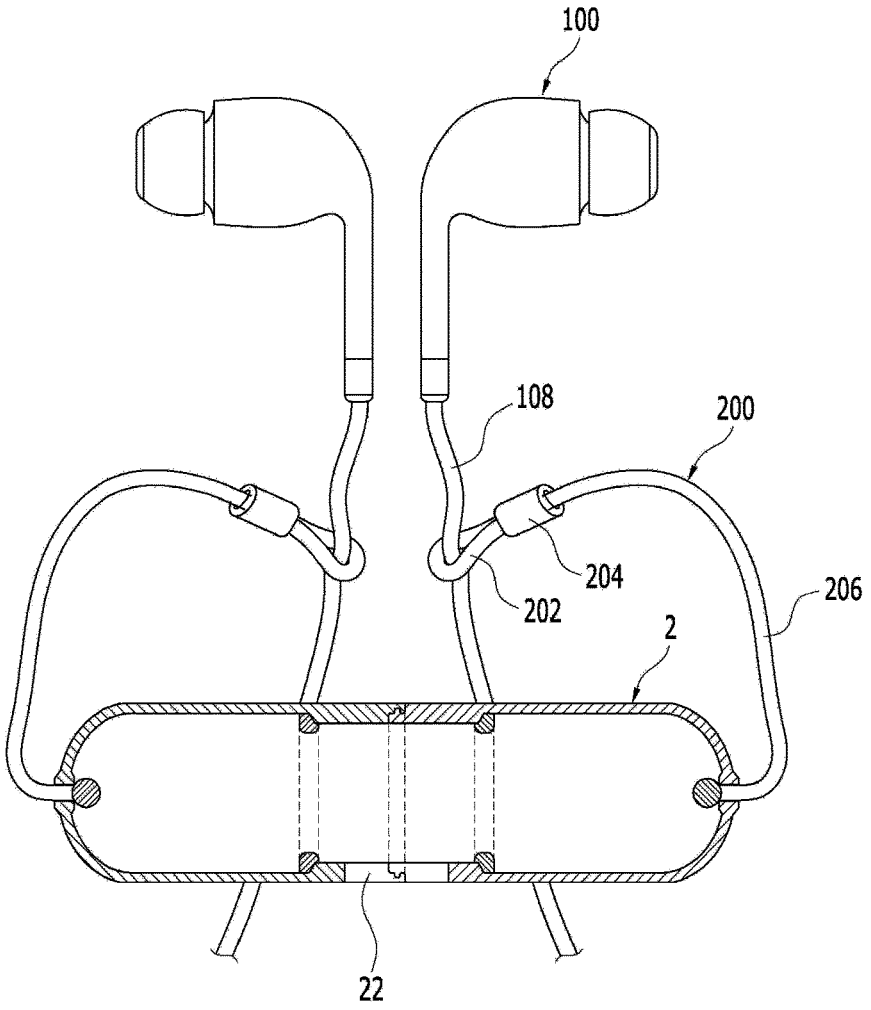
FIG. 2 is a view showing an example of use in which the earphones are taken out of the earphone protection device according to the present invention and then used.

FIG. 2 shows an example of use in which the earphones 100 are taken out of the earphone protection device 1 according to the present invention and then used.

Although the earphones 100 may be used in the state in which the pair of earphone covers 2 are not closed, the two earphone covers 2 may be assembled together by pushing the earphone covers 2 from both sides so that the stop protrusions 8 are engaged with the corresponding accommodation depressions 8*a* and the accommodation depressions 10 accommodate the corresponding stop protrusions 10*a*, as shown in the drawing and described above.

When a user pulls the length adjustment members 204 at appropriate locations while moving the loops 202 of the adjustment cables 200 along the cables 108, the loops 202 are tightened around the cables 108. Accordingly, the earphone covers 2 are not separated from the cables 108, and there is no risk that the earphone covers 2 are lost. Furthermore, in the state in which the earphones 100 have been taken out of the earphone protection device 1, the earphone protection device 1 may be substantially separated from the earphones 100 and may be fastened at appropriate locations along the cables 108, thereby eliminating concern about an impediment to a user.

Figure 3:
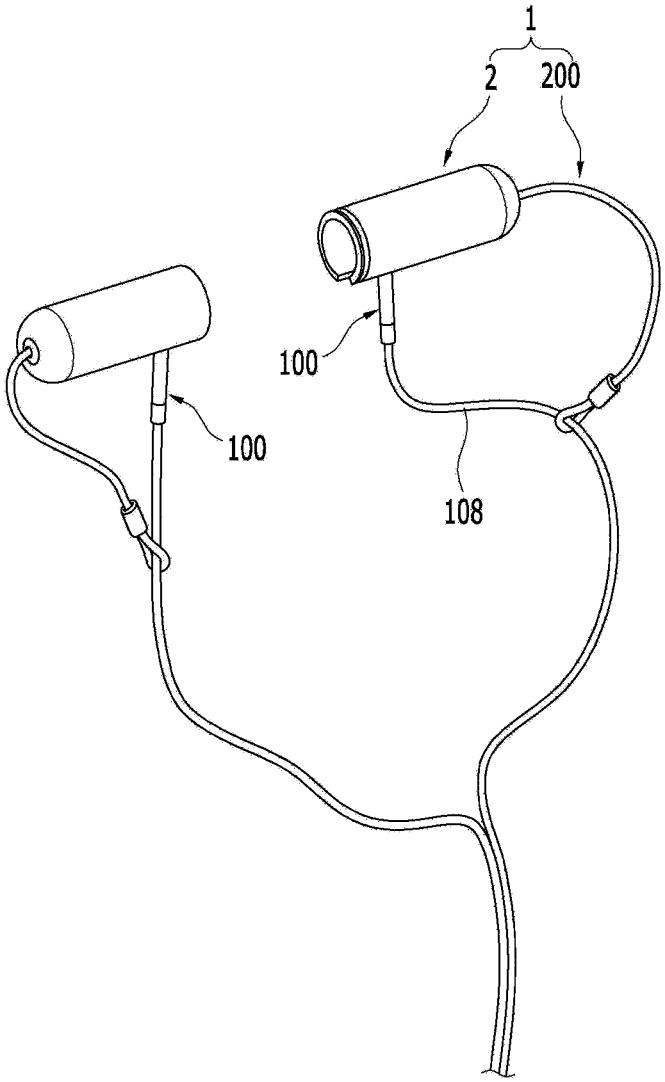
FIG. 3 is a view showing a state in which the earphones are accommodated in the earphone protection device according to the present invention, which shows a state before the earphone covers are coupled to each other.
Figure 4:
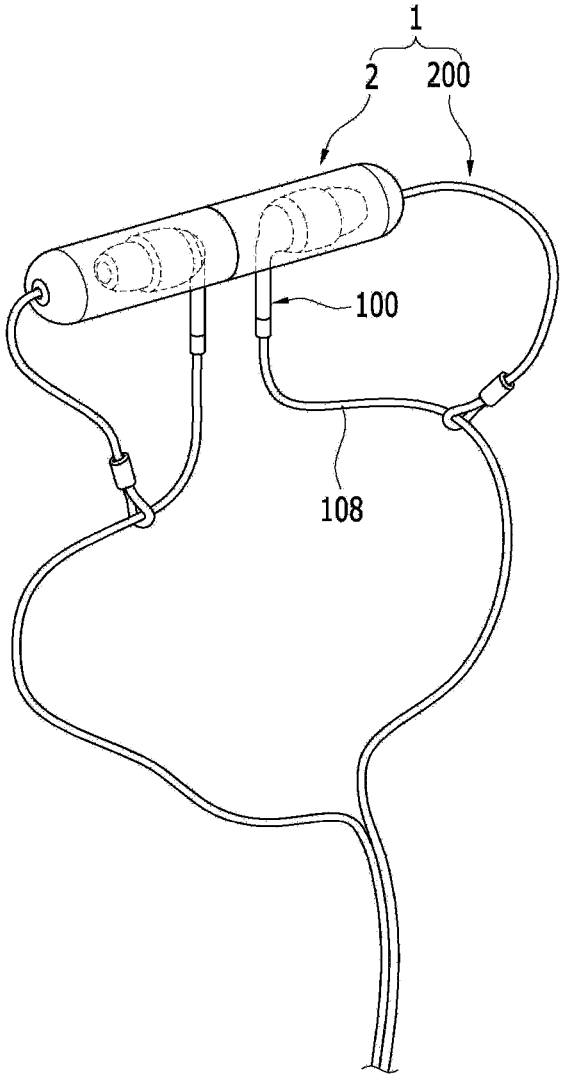
FIG. 4 is a view showing a state in which the earphones are accommodated in the earphone protection device according to the present invention, which shows a state in which the earphone covers have been coupled to each other.

FIGS. 3 and 4 are views showing a state in which the earphones 100 are accommodated in the earphone protection device 1 according to the present invention. FIG. 3 shows a state before the earphone covers 2 are coupled to each other, and FIG. 4 shows a state in which the earphone covers 2 have been coupled to each other.

FIG. 4 clearly shows the advantages of the present invention different from those of Korean Patent No. 1607199. When the earphones 100 are accommodated, the neck portions 102 of the earphones 100 are sufficiently accommodated via the slot 22 provided to communicate with the first spaces S1, and thus the earphone covers 2 can be assembled together without causing any interference with the earphones 100. Accordingly, the earphones 100 can be more conveniently stored, actions of a user can be easily performed by reducing the space occupied by the earphone protection device, and the disadvantage in which the earphones are easily taken out of the earphone covers 2 by small external force can be completely eliminated.

Figure 5:
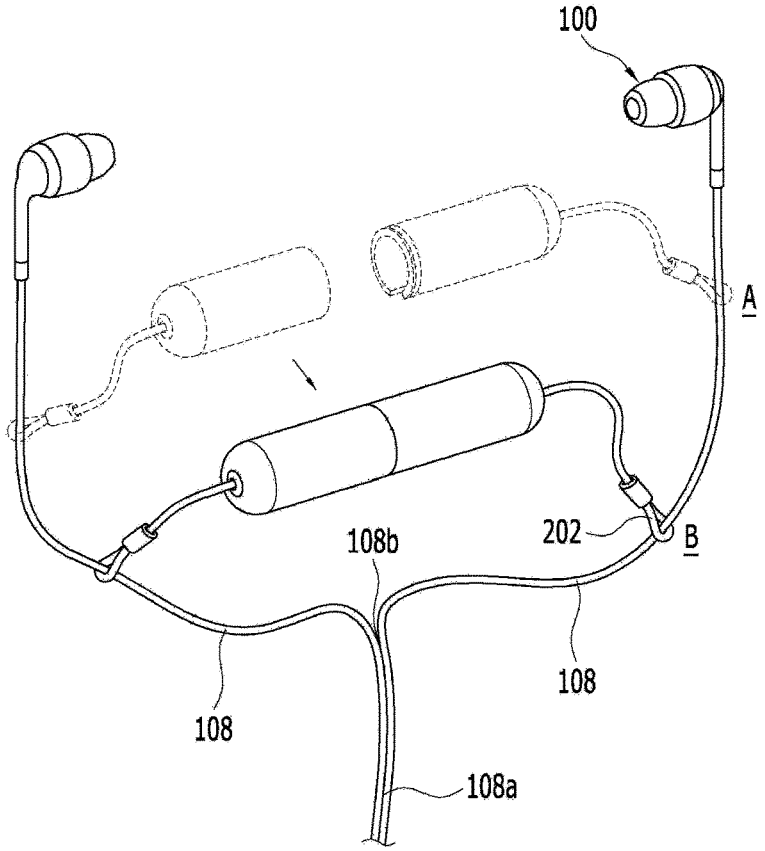
FIG. 5 is a view showing another example of the use of the earphone protection device according to the present invention.

FIG. 5 is a view showing an example of the use of the earphone protection device 1 according to the present invention, into which FIGS. 2 to 4 are integrated.

When the earphones 100 are used, the inconvenience in which the earphone covers 2 are close to a user's ears can be eliminated by assembling the earphone covers 2 together at locations "A" where the earphone covers 2 are open or at locations "B" where the adjustment cables 200 have been pulled downward.

When the earphones 100 are accommodated and stored in the earphone protection device 1, the earphones 100 may be accommodated in the earphone covers 2 and also the earphone covers 2 are assembled together at any locations, for example, locations "A" or locations "B," in the same manner, and then the loops 202 may be maximally moved toward a connection point 108*b*. Thereafter, combined cables 108*a* may be separated from an electronic device, and the overall volume of the earphones 100 and the earphone protection device 1 may be reduced by freely winding or rolling all cables 108, 108*a* and 200, thereby enabling the earphones 100 and the earphone protection device 1 to be put into and carried in a pocket or bag. Accordingly, the earphone protection device 1 is substantially integrated with the earphones 100, thereby considerably facilitating storage, carrying, and use.

The specific embodiments of the present invention have been described as examples, and various modifications may be made to the present invention. For example, the accommodation depression-protrusion structure configured to assemble the earphone covers together may be replaced with a screw-type rotation coupling structure based on screw thread engagement. Furthermore, the connection lines of the adjustment cables may be connected via the portions of the covers other than the second side surfaces of the covers. Moreover, the sizes, locations and shapes of all the components described in conjunction with the present invention do not limit the range of the rights of the present invention.

The present invention has the effect of providing the earphone protection device which is robust, has desirable safety, and provides improved user convenience.

The range of the rights of the present invention is defined by the attached claims. It will be apparent that the range of the rights of the present invention includes ranges identical and equivalent to those of the attached claims.

What is claimed is:

1. An earphone protection device, comprising:

a pair of earphone covers and a pair of adjustment cables;

wherein an outer first space and an inner second space are formed inside each of the earphone covers, and the first space provides a path adapted to guide earphones through accommodation and also provides a coupling structure so that the earphone covers are assembled together and closed after the earphones have been accommodated inside the earphone covers, wherein stepped portions configured to come into contact with surfaces of the earphones are formed on respective inner circumferential surfaces of the earphone covers, and the outer first space and the inner second space are defined based on each of the stepped portions, and wherein an open slot configured to receive and accommodate the earphones is formed through bottom surfaces of the earphone covers.

2. The earphone protection device of claim 1, wherein:

an open first side surface is formed at an entrance of each of the earphone covers, and a curved closed second side surface is formed opposite the first side surface; and one stop protrusion and one accommodation depression are formed on an inside of a front end of a first side surface of one of the pair of earphone covers, and another accommodation depression and another stop protrusion configured to be engaged with the one stop protrusion and the one accommodation depression are formed on an inside of a front end of a first side surface of a remaining one of the pair of earphone covers.

3. The earphone protection device of claim 1, wherein:

an open first side surface is formed at an entrance of each of the earphone covers, and a curved closed second side surface is formed opposite the first side surface; and first screw threads are formed on an inside of a front end of a first side surface of one of the pair of earphone covers, and second screw threads configured to be engaged with the first screw threads are formed on an inside of a front end of a first side surface of a remaining one of the pair of earphone covers.

4. The earphone protection device of claim 2, wherein each of the adjustment cables includes a loop connected to each of cables of the earphones and a long connection line configured to extend from the loop, a length adjustment member is located between the loop and the connection line, and an enlarged portion is formed at a front end of the connection line.

5. The earphone protection device of claim 2, wherein the earphone covers are made of elastic soft or hard plastic or rubber, and include frames composed of housings having a sideways "U"-shaped section.

* * * * *